US012668943B2

(12) United States Patent
Azzolin et al.

(10) Patent No.: US 12,668,943 B2
(45) Date of Patent: Jun. 30, 2026

(54) COUPLING DEVICE FOR A TOOL

(71) Applicant: MECCANICA BREGANZESE S.P.A. in breve Mb S.p.A., Fara Vicentino (IT)

(72) Inventors: Diego Azzolin, Fara Vicentino (IT); Guido Azzolin, Breganze (IT)

(73) Assignee: MECCANICA BREGANZESE S.P.A. in forma abbreviata MB S.P.A., Fara Vicentino (IT)

( * ) Notice: Subject to any disclaimer, the term of this patent is extended or adjusted under 35 U.S.C. 154(b) by 183 days.

(21) Appl. No.: 18/583,902

(22) Filed: Feb. 22, 2024

(65) Prior Publication Data

US 2024/0287753 A1 Aug. 29, 2024

(30) Foreign Application Priority Data

Feb. 23, 2023 (IT) ..... 102023000003150

(51) Int. Cl.
*E02F 3/00* (2006.01)
*E02F 3/36* (2006.01)
*E02F 3/96* (2006.01)

(52) U.S. Cl.
CPC ..... *E02F 3/3677* (2013.01); *E02F 3/3609* (2013.01); *E02F 3/965* (2013.01)

(58) Field of Classification Search
None
See application file for complete search history.

(56) References Cited

U.S. PATENT DOCUMENTS 3,773,116 A * 11/1973 Coontz ..... E02F 3/7613 172/822
4,076,080 A * 2/1978 Anderson ..... E02F 3/96 172/253
4,262,966 A 4/1981 Bouplon
4,405,019 A * 9/1983 Frisbee ..... E02F 3/7613 172/826
4,878,713 A 11/1989 Zanetis
4,890,798 A * 1/1990 Tagawa ..... E02F 3/3677 241/101.73
4,897,921 A * 2/1990 Ramun ..... B23D 17/06 30/228
4,962,816 A * 10/1990 Imon ..... E02F 9/22 172/821

(Continued)

FOREIGN PATENT DOCUMENTS

CN 115380651 A 11/2022
DE 3702285 A1 * 8/1988 ..... F16P 7/00

(Continued)

*Primary Examiner* — Steven M Marsh
(74) *Attorney, Agent, or Firm* — Carmel Patent Agency; Robert Ballarini

(57) ABSTRACT

A coupling device for a tool, which can be applied to a self-propelled vehicle, includes a main frame, a connection device to a coupling element of the self-propelled vehicle, and a translationally movable support body configured to support the tool in a work position. The translationally movable support body is mounted on the main frame in a translationally movable manner along a translation direction. The coupling device further includes a movement device of the translationally movable support body.

20 Claims, 3 Drawing Sheets

(56) References Cited

U.S. PATENT DOCUMENTS

| | | | | |
|---|---|---|---|---|
| 5,004,168 | A * | 4/1991 | Purser | E04G 23/082 241/101.73 |
| 5,203,615 | A | 4/1993 | Zanetis | |
| 8,506,204 | B1 | 8/2013 | Reames | |
| 10,966,363 | B2 | 4/2021 | Mollick | |
| 2009/0282710 | A1* | 11/2009 | Johnson | E02F 3/404 37/444 |
| 2016/0108603 | A1* | 4/2016 | Hoyt | E02F 3/7613 172/663 |
| 2017/0152646 | A1 | 6/2017 | Sewell | |
| 2019/0223369 | A1* | 7/2019 | Mollick | A01B 69/008 |

FOREIGN PATENT DOCUMENTS

| | | | | |
|---|---|---|---|---|
| EP | 538960 | A1 * | 4/1993 | E02F 3/3677 |
| EP | 2204502 | A2 * | 7/2010 | E02F 3/3677 |
| GB | 2512945 | A | 10/2014 | |

* cited by examiner

COUPLING DEVICE FOR A TOOL

CROSS-REFERENCE TO RELATED APPLICATIONS

The present application claims the benefit of priority to Italian Patent Application No. 102023000003150, filed on Feb. 23, 2023, the entire contents of which are incorporated in this application by reference.

TECHNICAL FIELD

The present invention relates to a coupling device for a tool, such as a pincer or a milling cutter, of the type comprising a main frame and a connection device to a coupling element of a self-propelled vehicle, for example a compact loader.

BACKGROUND

In the technical field of reference, it is known to use compact loaders, also known as skid loaders, as vehicles for the execution of various types of working through the application of special tools.

For example, these vehicles are used in the execution of road works through the application of rotating milling cutters, or still for shearing works through special pincers.

These tools are typically fixed to the arms of the loader, thereby allowing to perform lifting and lowering movements of the tools.

However, the arms of these vehicles are not normally provided with lateral movement, i.e., horizontal, and, consequently, tool attachment systems are used which also allow a horizontal movement thereof.

However, the known attachment systems have the disadvantage of not allowing the movement of the tool along the entire width of the loader.

In fact, the known attachment systems are configured in a manner that they do not extend beyond the lateral encumbrance of the vehicle, since in such applications the possibility of having compact dimensions, so as to guarantee the required handling, is particularly important.

However, the presence of the members responsible for moving the tool in a horizontal direction limits the useful stroke provided by the known attachment systems.

This problem can be observed, for example, in the solution described in British patent application GB2512945A, in which a linear actuator is used to perform the movement of a milling cutter along a horizontal guide.

The linear actuator is in fact arranged parallel to the guide and for obvious technical reasons, the stroke of the actuator cannot cover the entire encumbrance of the actuator.

A linear actuator for performing the movement of a milling cutter along a horizontal guide is also provided in U.S. Pat. No. 4,878,713A. Also in this case, the encumbrance of the actuator limits the useful stroke of the milling cutter.

A further solution is described in U.S. Pat. No. 4,262,966A which provides for the use of a screw actuator responsible for the horizontal movement of a milling cutter. Although this solution allows a greater stroke in relation to the overall dimensions of the movement system, it allows a rather limited movement speed and, above all, does not lend itself well to applications that are particularly exposed to dust, such as road workings. Indeed, the screw actuator can be easily damaged by the presence of dirt and dust which, for obvious reasons, are present in significant quantity during the milling operations of the asphalt or of other surfaces.

SUMMARY

The problem underlying the present invention is to provide a coupling device for a tool, such as a pincer or a milling cutter, which can be applied to self-propelled vehicles and which is structurally and functionally designed to overcome at least in part one or more of the drawbacks set out above with reference to the conventional solutions.

Within the scope of this problem, an aim of the present invention is to provide a coupling device that allows an adequate movement capacity of the tool in a solution with contained dimensions.

Another aim is to provide a coupling device capable of being able to move a tool in a horizontal direction for a stroke that is substantially equal to the entire extension in this direction of the coupling device.

This problem is solved and these objects are at least in part achieved by the invention by means of a coupling device for a tool, such as a pincer or a milling cutter, which can be applied to self-propelled vehicles, comprising a main frame, a connection device to a coupling element of said self-propelled vehicle and a translationally movable support body configured to support said tool in a work position.

Preferably said support body is mounted on said main frame in a translationally movable manner along a translation direction.

The coupling device preferably comprises a movement device for said support body.

Said movement device preferably comprises a linear actuator which is secured to said main frame and which is connected by means of a lever mechanism to said translationally movable support body so as to move said translationally movable support body along said translation direction.

It will be appreciated that the presence of the lever mechanism allows to obtain an indirect movement of the tool, realizing a multiplier effect of the stroke of the actuator.

Consequently, the actuator can perform the movement of the tool for a distance greater than the stroke of the actuator and substantially coinciding for the entire extension of the coupling device.

The present invention may also have one or more of the following further preferred features.

Preferably said lever mechanism comprises a lever arm hinged to said frame thereby realizing the lever mechanism in a simple manner and thus ensuring high reliability.

Preferably, the lever arm is hinged directly to said frame.

In some embodiments said lever arm is hinged to said frame so that a rotation of the lever arm results in a translation of the translationally movable support body.

In some embodiments, said lever arm forms a lever of the second or third type with said linear actuator. These types are particularly advantageous in allowing a compact mechanism. It should be specified that, in the present context, "lever of the second type" preferably means a lever in which the resistant force (i.e., the force with which the translationally movable support body opposes the movement along the translation direction) is between the fulcrum (i.e., the point in which the lever is hinged to the main frame) and the driving force (i.e. the force provided by the linear actuator), while "lever of the third type" preferably means a lever in which the driving force is between the fulcrum and the resistant force.

Preferably said lever arm is secured to said translationally movable support body. In some embodiments said lever arm is hinged to said frame in the region of a first end thereof and is secured to said translationally movable support body in the region of a second end thereof. Preferably, said linear actuator is connected to said lever arm in the region of an intermediate position of said lever arm.

In this way it is possible to realize the coupling device and the relative movement mechanism through a simple and rational structure.

In some embodiments said lever arm is connected to said translationally movable support body in a sliding manner, preferably along a transverse direction with respect to said translation direction. This feature allows to further increase the distance that the stroke of the linear actuator allows the support body to perform.

Preferably said translationally movable support body comprises a guide, said lever arm being slidable in said guide. In this way, the possibility of moving in translation the constraint between the lever arm and the support body is made in a simple and particularly resistant way.

Preferably the guide develops along a direction which is substantially perpendicular to said translation direction allowing to optimize the distance that the support body can travel.

In some embodiments, the frame has a substantially rectangular shape, said linear actuator being secured, preferably in a rotatable manner, in the region of a flank of said frame. Preferably said linear actuator is secured near a corner of said frame. It is further preferred that the lever arm, in particular at the first end thereof, is hinged to the frame in the region of a side of said frame which is contiguous to said flank.

These characteristics also make it possible to optimise the overall encumbrances of the coupling device.

Preferably said frame comprises a guide element along which said translationally movable support body moves in translation. Preferably said linear actuator is secured to said frame in a position adjacent to said guide element. In this way, the oscillation of the lever arm can take place in the region of the areas of the frame which are distal with respect to that in which the linear actuator is positioned.

In some embodiments said translationally movable support body comprises a plate in the region of which the tool is mounted. Thanks to the presence of the plate it is possible to mount the tool in a simple and particularly stable way. At the same time, the plate lends itself particularly well to the translation on the frame.

Further preferred aspects are also defined in the appended claims as well as by the following description.

In the present description as well as in the claims appended hereto, and more generally in the context of the present invention, some terms and expressions are deemed to assume, unless otherwise explicitly indicated, the meaning expressed in the following definitions.

In particular, with the term "substantially perpendicular" referred to two directions, it is understood that these directions are perpendicular to each other or deviate from a perfect perpendicularity preferably by a maximum of 10 degrees and even more preferably 5 degrees.

With the term "substantially rectangular" referred to the shape of an object, it will be understood that this has at least one section that reminds a rectangle or a square. Preferably, in an object having two prevalent dimensions with respect to the other, this section coincides with that defined by the two larger dimensions. The sides of the rectangle do not necessarily have to be regular, since it is contemplated that there are elements that protrude or retract with respect to perfectly straight sides. The sides may also be substantially perpendicular to each other.

It is to be understood that both the foregoing general description and the following detailed description are exemplary, but are not restrictive, of the disclosure.

BRIEF DESCRIPTION OF THE DRAWINGS

The characteristics and advantages of the invention will become clearer from the detailed description of preferred embodiments thereof, by way of non-limiting example, with reference to the appended drawings wherein.

DETAILED DESCRIPTION OF THE PREFERRED EMBODIMENTS

Figure 1:
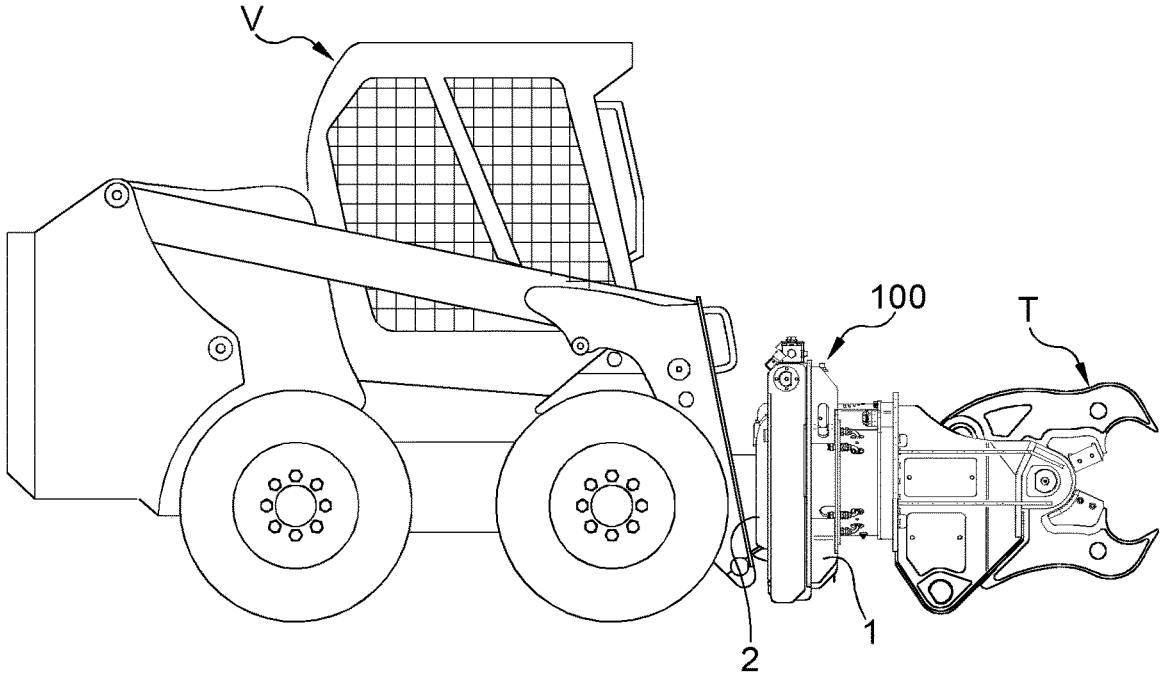
FIG. 1 is a side view of a vehicle to which a pincer-type tool is mounted by means of a coupling device according to the present invention.
Figure 2:
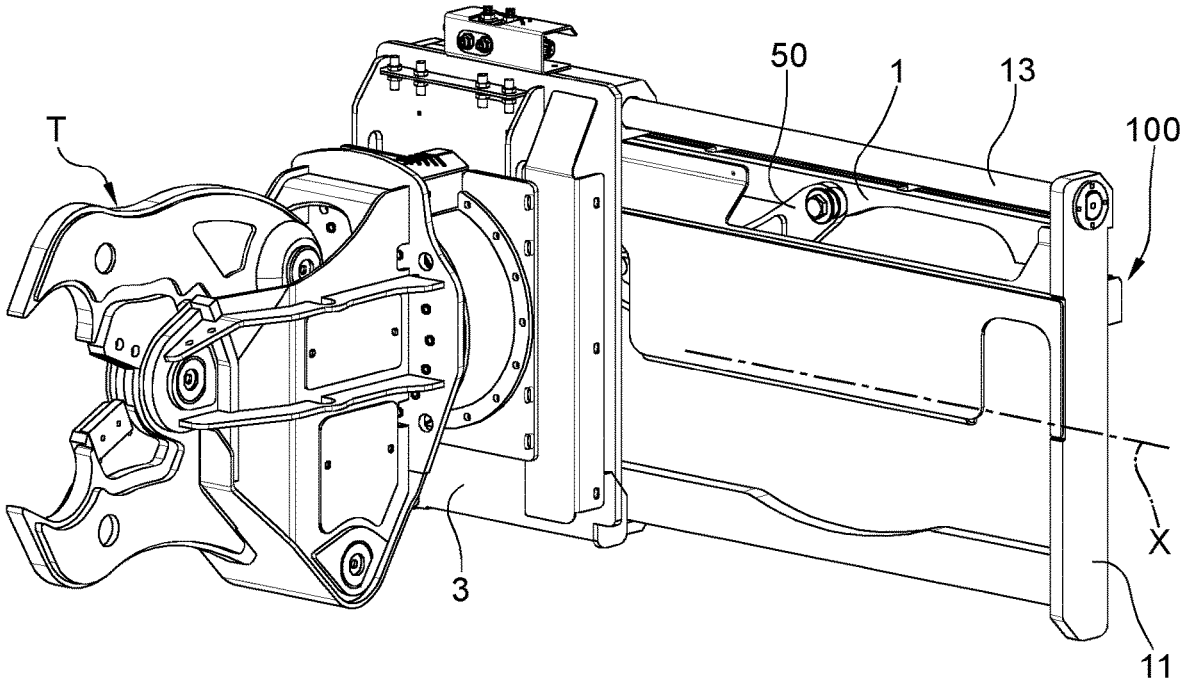
FIG. 2 is a perspective view of the coupling device of the present invention.

With reference initially to FIGS. 1 and 2, a coupling device for a tool T is indicated as a whole with the reference numeral 100.

In the exemplary embodiment illustrated in the figures, the coupling device 100 is used to apply a pincer to a compact loader or skid loader.

It is however evident that the coupling device according to the present invention can be used to apply a pincer or other types of tools to self-propelled vehicles V of any type.

The coupling device 100 comprises a main frame 1 and a connection device 2 that allows the connection thereof to a relative coupling element of the self-propelled vehicle V, for example represented by the arms on which the loader is normally supported.

The coupling device 100 further comprises a translationally movable support body 3 on which the tool T is supported in a relative work position.

For example, as can be observed from FIG. 1, in the case of a compact loader the tool is placed so as to extend longitudinally in front of the vehicle, so that it can be used for workings of various type.

Preferably, the translationally movable support body 3 comprises a plate 32 in the region of which the tool T is mounted.

As can best be observed from FIG. 2, the support body 3 is mounted on said main frame 1 in a translationally movable manner along a translation direction X.

For this purpose, the frame 1 may comprise a guide element 13 along which said translationally movable support body 3 moves in translation.

Figure 3:
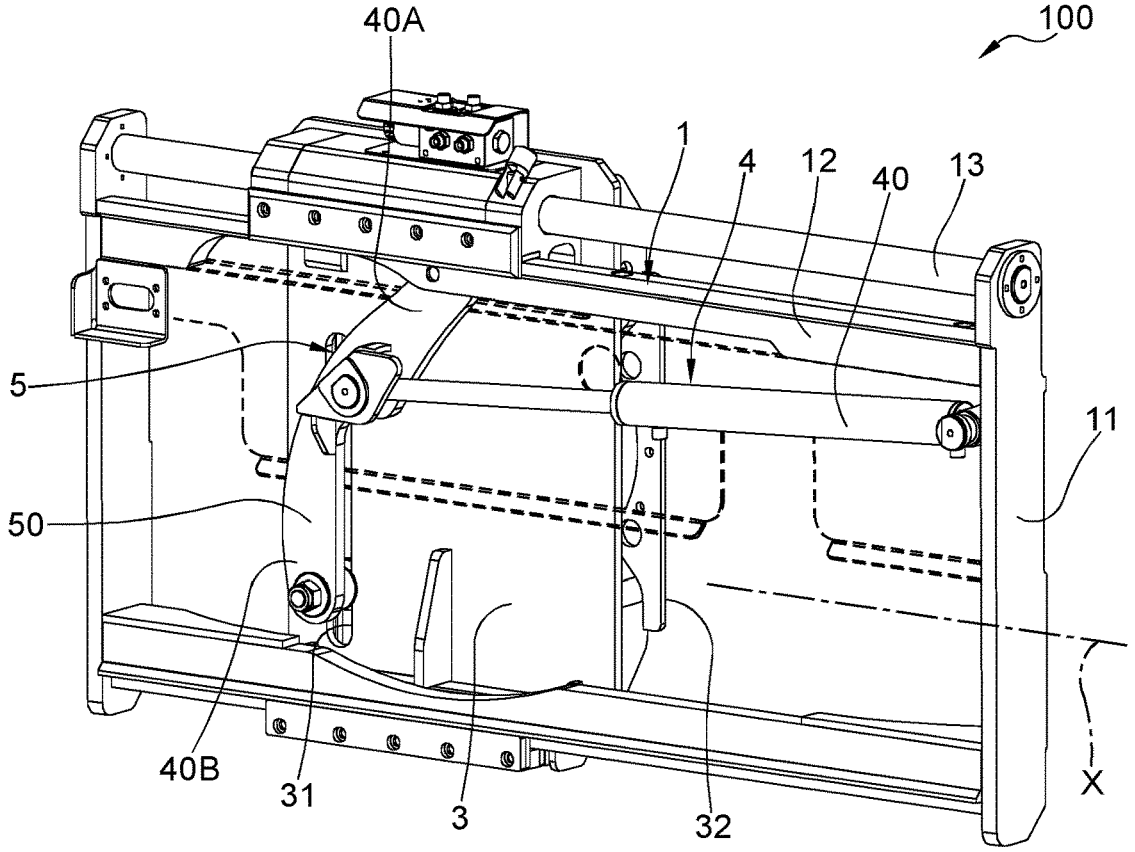
FIG. 3 is a perspective view, from the back, of the coupling device according to the present invention in which some details have been omitted for greater illustrative clarity.

The movement of the support body 3 is achieved through a special movement device 4, better illustrated in FIG. 3.

The movement device 4 comprises a linear actuator 40 which is secured to the main frame 1 and which is connected by means of a lever mechanism 5 to the translationally movable support body 3.

In preferred embodiments, the lever mechanism 5 comprises a lever arm 50 hinged to the frame 1 which forms a lever of the second or third type with the linear actuator 40.

As can be observed from FIG. 3, the lever arm 50 is hinged to the frame 1 in the region of a first end 40A thereof and is secured to the translationally movable support body 3 in the region of a second end 40B thereof.

The linear actuator 40 is in turn connected to the lever arm 50 in the region of an intermediate position of said lever arm 50.

Figure 4:
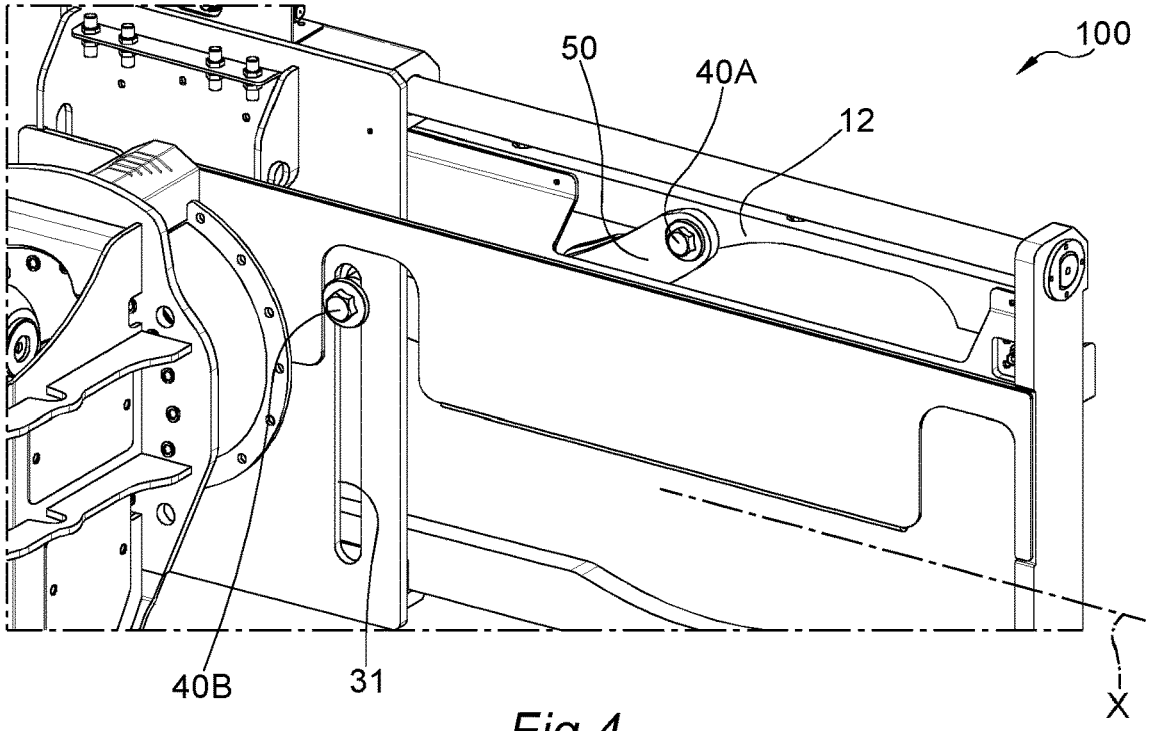
FIG. 4 is a perspective view of the coupling device of the present invention, with the pincer-like tool mounted, in a first position along a translation direction of the tool itself.
Figure 5:
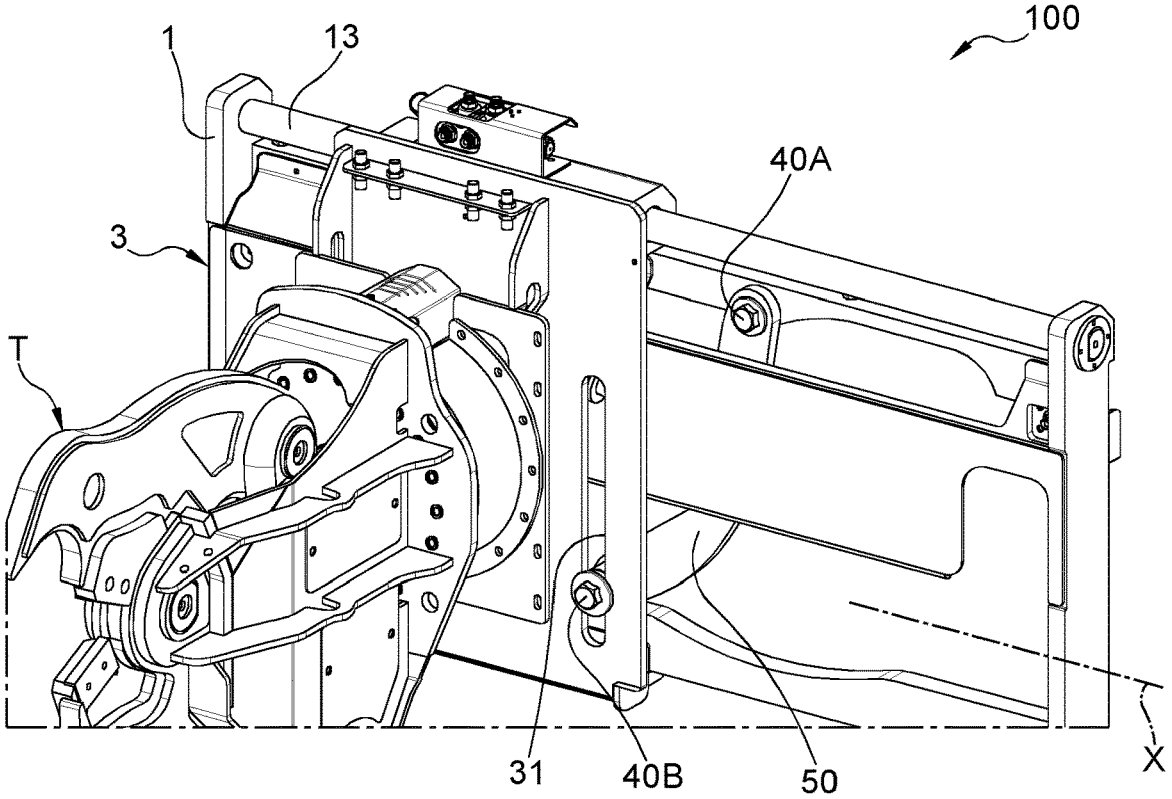
FIG. 5 is a perspective view of the coupling device of the present invention, with the pincer-like tool mounted, in a second position along the translation direction away from the aforesaid first position.
Figure 6:
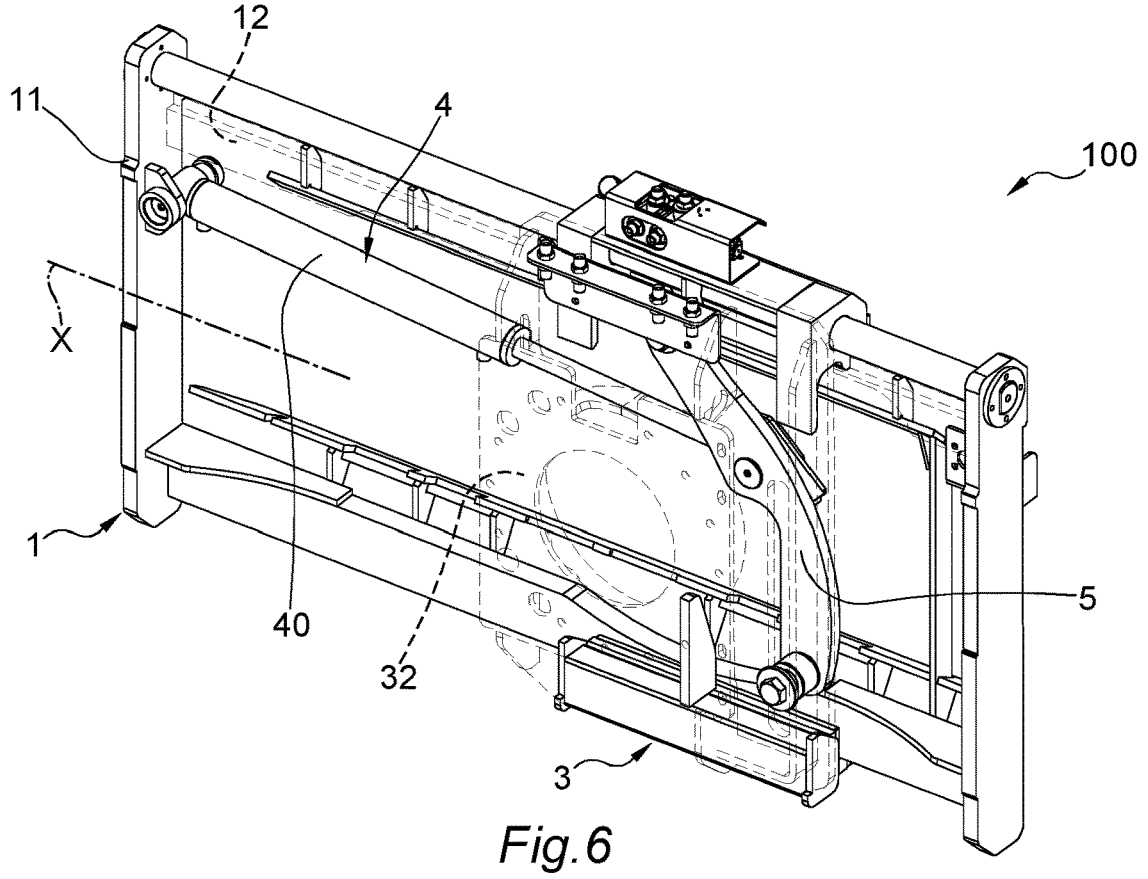
FIG. 6 is a further perspective view of the coupling device of the present invention, in a third position along the translation direction further away from the aforesaid first position.

As can therefore be observed from FIGS. 4 to 6, the actuation of the linear actuator 40, i.e., the extension thereof, consequently allows the movement of the support body 3 along the translation direction X.

It will also be appreciated that, in preferred embodiments, the translationally movable support body 3 comprises a guide 31, said lever arm 50 being slidable in said guide 31.

In this way the lever arm 50 can be connected to the translationally movable support body 3 in a sliding manner, along a transverse direction with respect to said translation direction X.

Thanks to this feature, in a first part of the movement of the actuator the lever arm 50 slides along the guide 31 and the movement of the lever mechanism itself starts only after the arm 50 has reached the limit position along the guide.

This movement can be appreciated by observing FIGS. 4 to 6, in which the support body 3 is moved in translation from a position close to a first end of the frame to a position close to the opposite end.

It will also be appreciated that, in preferred embodiments, the frame has a substantially rectangular shape, said linear actuator 40 being secured, preferably in a rotatable manner, in the region of a flank 11 of the frame 1 which corresponds to one of the two aforesaid ends.

Preferably, the linear actuator 4 is secured near a corner position of the frame 1, adjacent to the guide element 13 on which the support body 3 slides.

This position may correspond to an upper corner of the frame 1, with the guide element 13 placed in the region of an upper side of the frame 1 itself.

The frame 1 is preferably extended along the translation direction X.

Preferably, the substantially rectangular shape of the frame 1 defines two pairs of opposite sides comprising respectively two sides 12 and two flanks 11.

The sides 12 are preferably extended along the translation direction X, while the flanks 11 are preferably substantially perpendicular to the translation direction X.

The first end 40A of the lever arm is preferably secured to the frame 1 in the region of a side 12 of the frame which, preferably, is contiguous to the flank 11 in the region of which the linear actuator 40 is secured.

The same side 12 is preferably adjacent to the guide element 13.

In this way, a compact and particularly resistant structure is obtained.

The invention thus achieves the proposed objectives while also achieving numerous advantages over the prior art of reference, including a high movement capacity, in the context of a solution with contained overall encumbrances, which is rational and with relatively low construction costs.

Although illustrated and described above with reference to certain specific embodiments, the present disclosure is nevertheless not intended to be limited to the details shown. Rather, various modifications may be made in the details within the scope and range of equivalents of the claims and without departing from the spirit of the disclosure.

What is claimed is:

1. A coupling device for a tool, which can be applied to a self-propelled vehicle, comprising:

a main frame;

a connection device connectable to a coupling element of said self-propelled vehicle;

a translationally movable support body which is configured to support the tool in a work position, said translationally movable support body being mounted on said main frame in a translationally movable manner along a translation direction;

a movement device for said translationally movable support body; wherein said movement device comprises a linear actuator which is secured to said main frame and which is connected by means of a lever mechanism to said translationally movable support body so as to move said translationally movable support body along said translation direction, said lever mechanism comprising a lever arm which is hinged to said frame.

2. The coupling device according to claim 1, wherein said lever arm forms a lever of the second or third type with said linear actuator.

3. The coupling device according to claim 1, wherein said lever arm is secured to said translationally movable support body.

4. The coupling device according to claim 3, wherein said lever arm is hinged to said frame in the region of a first end thereof and is secured to said translationally movable support body in the region of a second end thereof.

5. The coupling device according to claim 4, wherein said linear actuator is connected to said lever arm in the region of an intermediate position of said lever arm.

6. The coupling device according to claim 1, wherein said lever arm is connected to said translationally movable support body in a sliding manner.

7. The coupling device according to claim 6, wherein said lever arm is connected to said translationally movable support body in the sliding manner along a transverse direction with respect to said translation direction.

8. The coupling device according to claim 6, wherein said translationally movable support body comprises a guide, said lever arm being slidable in said guide.

9. The coupling device according to claim 8, wherein said guide develops along a direction which is substantially perpendicular to said translation direction.

10. The coupling device according to claim 1, wherein said frame has a substantially rectangular shape, said linear actuator being secured in a region of a flank of said frame.

11. The coupling device according to claim 10, wherein said linear actuator is secured in a rotatable manner in the region of said flank.

12. The coupling device according to claim 10, wherein said linear actuator is secured proximate to a corner of said frame.

13. The coupling device according to claim 10, wherein said lever arm is hinged to said frame in a region of a side of said frame which is contiguous to said flank.

14. The coupling device according to claim 1, wherein said frame comprises a guide element, along which said translationally movable support body moves in translation.

15. The coupling device according to claim 14, wherein said linear actuator is secured to said frame in a position adjacent to said guide element.

16. The coupling device according to claim 1, wherein said translationally movable support body comprises a plate, in the region of which the tool is mounted.

17. The coupling device according to claim 1, wherein said lever arm is hinged directly to said frame.

18. The coupling device according to claim 1, wherein said lever arm is hinged to said frame so that a rotation of the lever arm results in a translation of the translationally movable support body.

19. A coupling device for a tool, which can be applied to a self-propelled vehicle, comprising:

a main frame;

a connection device connectable to a coupling element of said self-propelled vehicle;

a translationally movable support body which is configured to support the tool in a work position, said translationally movable support body being mounted on said main frame in a translationally movable manner along a translation direction;

a movement device for said translationally movable support body;

wherein said movement device comprises a linear actuator which is secured to said main frame and which is connected by means of a lever mechanism to said translationally movable support body so as to move said translationally movable support body along said translation direction, wherein said lever arm is hinged to said frame in a region of a first end thereof and is secured to said translationally movable support body in a region of a second end thereof, and wherein said linear actuator is connected to said lever arm in the region of an intermediate position of said lever arm.

20. A coupling device for a tool, which can be applied to a self-propelled vehicle, comprising:

a main frame;

a connection device connectable to a coupling element of said self-propelled vehicle;

a translationally movable support body which is configured to support the tool in a work position, said translationally movable support body being mounted on said main frame in a translationally movable manner along a translation direction;

a movement device for said translationally movable support body;

wherein said movement device comprises a linear actuator which is secured to said main frame and which is connected by means of a lever mechanism to said translationally movable support body so as to move said translationally movable support body along said translation direction, wherein said lever arm is hinged to said frame in a region of a first end thereof and is secured to said translationally movable support body in a region of a second end thereof, wherein said linear actuator is connected to said lever arm in the region of an intermediate position of said lever arm, and wherein said lever arm is connected to said translationally movable support body in a sliding manner along a transverse direction with respect to said translation direction.

* * * * *